United States Patent [19]

Stamm

[11] Patent Number: 4,946,058

[45] Date of Patent: Aug. 7, 1990

[54] TRAY APPARATUS FOR PATIENTS

[75] Inventor: John H. Stamm, Salt Lake City, Utah

[73] Assignee: Harold N. Wilkinson, Salt Lake City, Utah

[21] Appl. No.: 261,087

[22] Filed: Oct. 24, 1988

[51] Int. Cl.[5] ..... B65D 21/00; A47C 7/62; A61H 3/00

[52] U.S. Cl. ..... 220/23.83; 224/42.46 R; 135/66; 135/67; 211/116

[58] Field of Search ..... 220/20, 21, 23.83, 85 H; 206/557, 562; 224/42.46 R; 211/116; 135/66, 67

[56] References Cited

U.S. PATENT DOCUMENTS

| | | | |
|---|---|---|---|
| 2,530,736 | 11/1950 | Sheldon | 220/23.83 X |
| 3,025,996 | 3/1962 | Habicht et al. | 220/85 H X |
| 3,877,603 | 4/1975 | Holz | 220/22.83 |
| 4,184,618 | 1/1980 | Jones | 224/42.46 R |
| 4,346,912 | 8/1982 | Habib | 220/19 X |
| 4,449,750 | 5/1984 | Pultman | 224/42.46 R X |
| 4,491,233 | 1/1985 | Johnson | 220/23.83 |
| 4,491,257 | 1/1985 | Ingles | 224/42.46 R |
| 4,577,903 | 3/1986 | Wells | 224/42.46 R X |
| 4,676,416 | 6/1987 | Harmon | 224/42.46 R |

*Primary Examiner*—Steven M. Pollard

*Attorney, Agent, or Firm*—M. Ralph Shaffer

[57] ABSTRACT

Tray apparatus for patients, including a tray member having a bottom and contiguous sides upstanding from periphery thereof, and a removable plate, releasably disposed over said tray member and provided with a series of receptacle-receiving apertures. The apertures accommodate the placement of plate, cups and the like which, when inserted into the apertures, contact and are supported by the bottom of the tray member. Upstanding arms are fixably disposed relative to opposite sides of the tray member and are articulatively coupled to horizontal cross-bar structure by means of a type of link. The composite tray structure enjoys a gravity-assist, whereby such tray structure is maintained essentially in a horizontal position even though its support might be jarred or even moving. Locking means is provided for releasably locking the tray structure to external support structure.

4 Claims, 3 Drawing Sheets

TRAY APPARATUS FOR PATIENTS

FIELD OF THE INVENTION

The present invention relates to tray apparatus for patients and, more particularly, provides a new and improved tray structure, and ancillary structure associated therewith, to allow the tray to be releasably locked in horizontal position and also to be unlocked, that movements of the supporting structure will not effect the essential horizontal alignment of the tray. Various features of the tray and its ancillary structure are hereinafter described.

BACKGROUND OF INVENTION AND BREIF DESCRIPTION OF PRIOR ART

Many medical patients, elderly people, and the like require a variety of apparatus for their comfort and physical movement, e.g., apparatus such-as wheelchairs, walkers and bed tray structures. There is ever present the challenge of providing a suitable tray for carrying or at least containing, and supporting a variety of items such as papers, magazines, and even eating utensils at mealtime. Tray apparatus needs to be adapted for external support, not requiring use of the patient's hands. Trays for walkers have been devised heretofore and have been engineered for mounting to walkers so that the patient will not require the use of his hands to support the tray, but rather can use his hands to support part of his body weight on the walker.

When ambulatory, patients often experience difficulties in keeping the tray level. The invention herein provides an articulate and articulative suspension of the tray so that the tray is maintained in an essentially horizontal position, even though a walker, for exmaple, may be tipped or subject to jarring during transit. A similar type of suspension is provided the tray, wherein the same is releasably mounted to a wheelchair or, for example, even to a bed tray support structure. One important concept, therefore, in the invention, is to have a tray that is gravity-assisted to maintain a substantially horizontal planar disposition even though its support structure may be tipped or even jarred. By this feature, the contents of the tray remain undisturbed and food items less subject to spilling, and so forth.

Certain types of trays, in the past, have had upstanding arms that are pivoted to the tray; this is deemed unwise since a maldistribution of articles on the tray results in spilling, where the center of gravity of such articles is not in the same plane as the pivot points of the arms.

Additionally, the present invention uses an articulative suspension structure including a link, whereby movements are dampened, thereby reducing tendencies of slight swinging movements that might otherwise occur. Certain U.S. Pat. Nos. are known which, in general, are related to the broad concept of walkers and carries therefore, as follows:

2,745,465, 4,184,618,
3,957,071, 4,676,416,
4,074,683, 4,708,274,

It can be seen that the general concept of a tray suspended from a walker, standing alone, is not new in the art. However, prior walkers and tray structures are believed unsuited to the gravity-assist function of the articulative suspension structure in the present invention; likewise, several additional features are found in the present invention, not shown in the prior art as known, including the concept of removable perforate trays or plates, releasable locking means for fixing tray disposition when structure is at rest, sponge-like resilient boots or safety pads disposed at the bottoms of walker legs, and other features as will hereinafter be set forth. So far as the suspension feature itself is concerned, the prior art does not appear to incorporate an intermediate link structure and flexible connection to the cross-bar of a walker or other structure whereby any movements which do occur can be dampened. In this invention, under most operating conditions there will be a free and uniform adjusment of a tray to its intended horizontal position, even though the walker, wheelchair, or other structure may be temporarily tipped.

BREIF DESCRIPTION OF PRESENT INVENTION

Fundamental novel concepts herein resides in the provision of a tray structure for patients and elderly people, for example, which tray structure includes a tray member having raised sides and a bottom forming a tray well, and also including an apertured plate disposed over and removably supported by the tray member. The plate includes a series of apertures for accommodating the transverse peripheries of flasks, cups, glasses, plates, and other types of food or eating receptacles. Thus, the sides of the receptacles will be supported against horizontal movement by the peripheral edges defining the apertures of the plate; the bottoms of the food receptacles may rest upon and be supported by the bottom of the tray member. Accordingly, in this condition the tray is suitable for holding dinnerware and the like. When it is desired to simply use the tray member for holding newspapers, magazines and so forth, the plate is simply conveniently removed to expose the inner-well surface for containing such items as may be desired.

The tray member itself has rigid, upstanding opposite arms provided with apertures that accommodate a link engagement. In a preferred form of the invention, the link structure used as a ring-like snap, the links used being secured by suitable tie means to the cross bar, for example, of a walker. The use of such linkage accommodates easy removal and replacement of the composite tray structure and, also, provides for a relative swinging adjustment of the tray structure relative to the walker so that even though the latter, in transit, may tip slightly, the tray yet remains its horizontal position. For instances of jarring, the link provides a reduced stiff lever arm, relative to the arms of the tray structure, so that tentative movements of the tray structure will be dampened during jarring intervals.

The tray structure itself is suitable for incorporation in wheelchair, bed tray, and walker designs. Hand manipulative locking means is provided to secure the tray against inadvertent movement once the walker or wheel chair, for example, is at a rest position and the patient desires to eat or otherwise employ this structure. Boots or pads of sponge-like character are disposed over the walker feet so as to preclude serious injury to the patient's toes when they do contact, in an abrupt manner, the bottom leg portions of the walker.

OBJECTS

Accordingly, a principal object of the present invention is to provide a new and improved tray structure for use by patients, elderly people, and the like.

A further object is to provide a tray structure suitable for incorporation in walker designs, in wheelchairs, and in bed tray supports.

An additional object is to provide a tray structure, which is constructed to accommodate both food receptacles and, by the removal of an apertured plate of such tray structure, to accommodate other items such as magazines, papers, and personal belongings.

A further object is to provide in a patient-aid utility tray structure, wherein the same incorporates rigid opposite arms and also respective articulative links, whereby to permit the tray structure to retain its general horizontal positioning, even though support structure suspending the same may be tilted, tipped or jarred.

A further object is to provide an articulative suspension for tray structures usable in objects in the type described wherein tray movements, if any, are dampened through employment of the articulative link hereinafter fully described.

An additional object is to provide tray structures for patients which can be releasably locked, in horizontal position, for eating and other purposes and, yet, which can be unlocked so as to enjoy horizontal disposition even though the supporting structure may become moved, tipped, or otherwise displaced relative to the nominal position of the tray.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings in which:

BREIF DESCRIPTION OF THE DRAWINGS

DETAILED DESCRIPTION OF PREFERRED EMBODIMENTS

Figure 1:
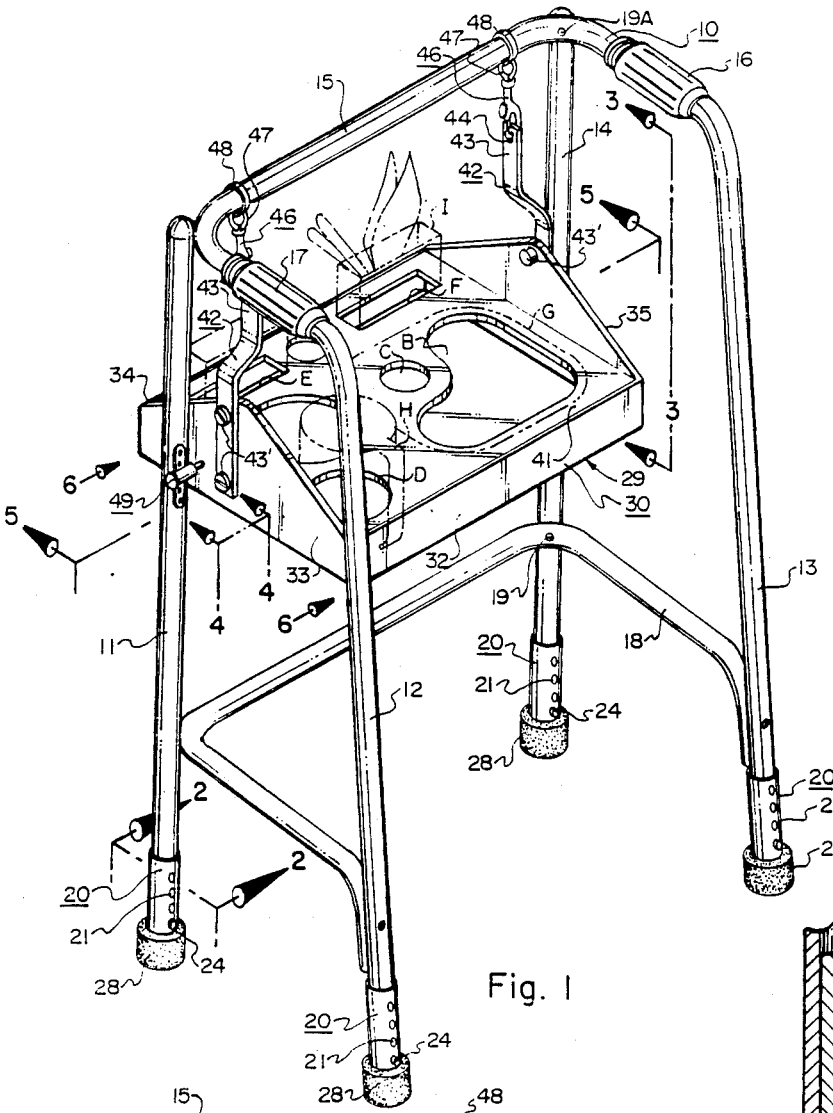
FIG. 1 is a rear perspective view of a walker, incorporating the patient tray of the present invention.
Figure 3:
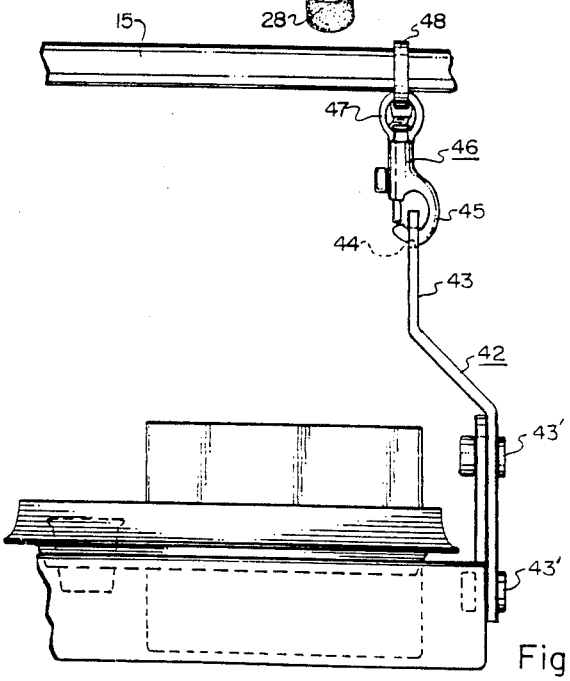
FIG. 3 is an enlarged elevation, taken along the line 3—3 in FIG. 1 of the right side of the tray, illustrating a representative suspension for suspending the tray from the crossbar of the walker.

In FIG. 1, walker 10 includes a series of legs 11–14 integral with and/or secured to crossbar 15. Turned side extensions of the crossbar 15 are provided with handles 16 and 17 for convenient patient use. A brace 18 may be employed for purposes of stability, which brace 18 is secured by attachments 19' to forward ones of the legs 11 and 14. The lower extensions of the legs are each provided with foot sleeves 20, see also FIG. 2, such foot sleeves having a series of apertures 21. The lower extensions 22 of each of the legs may be provided with a spring, shown in schematic form at 23, for pressing outwardly the detent button 24 secured thereto. Aperture 25 is provided for such detent button in the lower portion 22 of the leg. Plural apertures 21 are provided the foot sleeve 20 so that a convenient height adjustment can be made for each of the legs, this to accommodate patient comfort. A plastic or other type of cap 27, of conventional design, may be employed for disposition over the lower end of the foot sleeve 20. A sponge-like safety pad 28 is provided. Its general configuration, preferably, is that of a cylinder having an internal bore, even though the cylinder may be tapered or assume another type of outward configuration as may be desired. The purpose for the inclusion of sponge-like pad 28 is to deter injury to the patient's toes, should he/she tend to shuffle forwardly and bump the lower extremities of the legs of a walker with the toes. Sufficient give will be supplied the sponge-like character of the foot pads so that toe injury is avoided.

As to the legs themselves, the upper portions may be made integral with, or simply fastened to, the crossbar structure 15 as by means of attachments 19A'.

Patient tray 29 includes, first of all, a tray member 30, having a bottom 31 and a series of sides 32 35. Sides 32 and 34 have interior recesses 36 and 37 which form respective, upwardly facing support shoulders 38 and 39. These support shoulders support the lower peripheral edge 40 of apertured plate 41. Plate 41 has a series of apertures B–F, for receiving various types of containers, dinnerware and the like such as cups, plates, and so on. One type of plate may include slight depressions, forming a plate well and also a cup well, for fitting into apertures B and C, the plate being designated by the phantom line G. Cup H, container I, and other types of containers may be employed for simply fitting into the apertures of the plate 41. The various dinnerware items, receptacles and containers having bottoms which rest upon the bottom 31 of the tray member.

One special feature of the invention now immediately appears. With the apertured plate 41 installed, the composite tray is suitable for containing and supporting a variety of dinnerware items and accessories. Again, the plate is supported by upwardly facing recessed shoulders 38 and 39 in FIG. 6.

Figure 6:
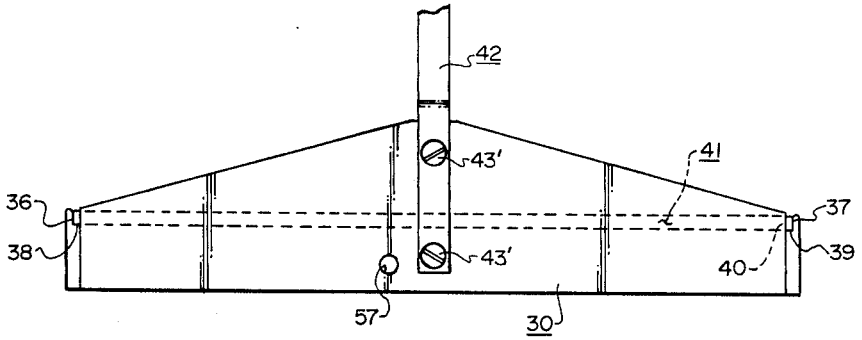
FIG. 6 is a side view of the tray in reduced scale, illustrating opposite recesses and upwardly facing shoulders for removably supporting the apertured plate of the composite tray.

With the utensils removed, the plate 41 can itself be removed to expose the well area of the tray member 30, so that the same can be used to contain and support books, papers, pencils, and other personal items. Accordingly, the composite tray may serve a dual function, depending upon whether or not one leaves the apertured plate 41 in place, as shown in FIG. 6, or whether one removes the same.

Of special importance is the inclusion of a pair of upstanding arms 42. Each of the arms is rigidly affixed by attachments 43' to the opposite sides 33 and 35 of tray member 30. As a convenience for certain types of walkers, the upstanding arms 42 may have respective dog leg configurements and be provided with upper portions 543, having upper apertures 44. These upper apertures receive the hook retainer ends 45 of an articulative, elongate respective link 46. Link 46 have upper portions comprising rings 47 each of which is secured by a plastic tie 48 to crossbar 15. The plastic ties loosely connect the upper ring-like ends of each link 46 so that there is some play and freedom of movement that is, or can be, involved.

It is important that the upstanding arms 42 be fixed and not pivoted to tray member 30. This is for the purpose of precluding effects such as tipping, should the composite centers of gravity of the receptacles and other food, as may be disposed on the tray, not be over the center-line of the tray, passing through lower portions of the arms. It is likewise important that an articulative connection be presented and be of elongate character, as shown by articulative links 46, whereby jarring or other abrupt movements can have but little effect relative to the nominal, horizontal disposition of the composite tray.

Figure 4:
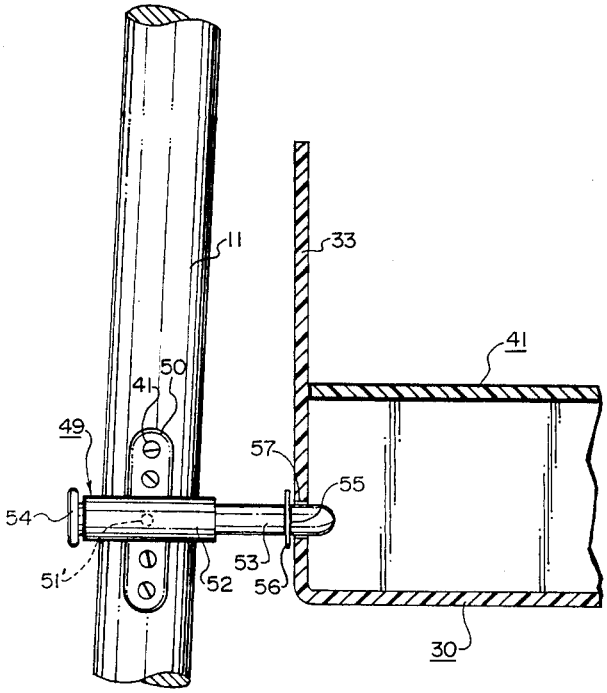
FIG. 4 is an enlarged detail, partially in section, and taken along the line 4—4 in FIG. 1, showing a representative locking mechanism that can be employed for releasably locking the tray in a fixed position relative to the walker's legs or other structure.

An important feature of the invention is shown in FIG. 4, wherein a representative leg 11 is shown to be provided with a lock mechansim 49 that is easily hand-manipulated. The same comprises a plate mount 50, having suitable attachments 51' for mounting the plate mount to leg 11. Pivoted or otherwise secured by portion 51 is sleeve 52, the latter being provided with a detent pin 53, having graspable knob 54. The pin 53 also may include a peripheral slot 55 accommodating the positioning of a C-ring retainer 56. Aperture 57 is provided in a respective side 33 of tray 30.

A similar locking mechanism, as shown in FIG. 4, will also be provided the opposite side of tray member 30 relative to leg 14.

Figure 2:
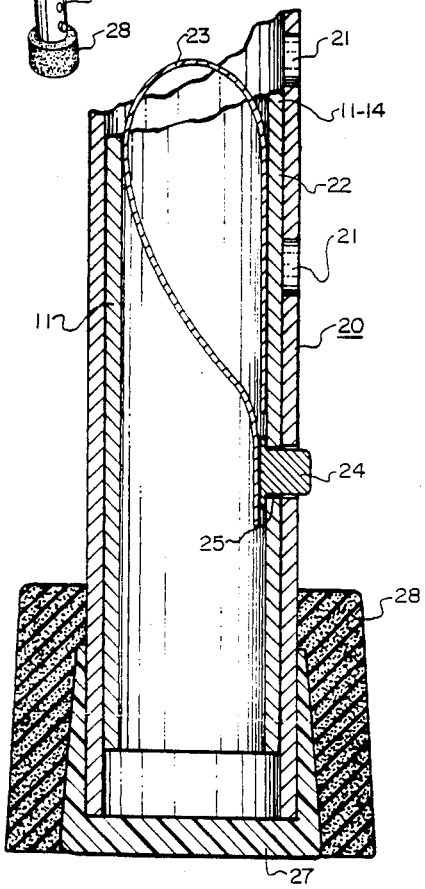
FIG. 2 is an enlarged section detail, taken along the line 2—2 in FIG. 1, of a lower portion of a representative leg of the walker.
Figure 5:
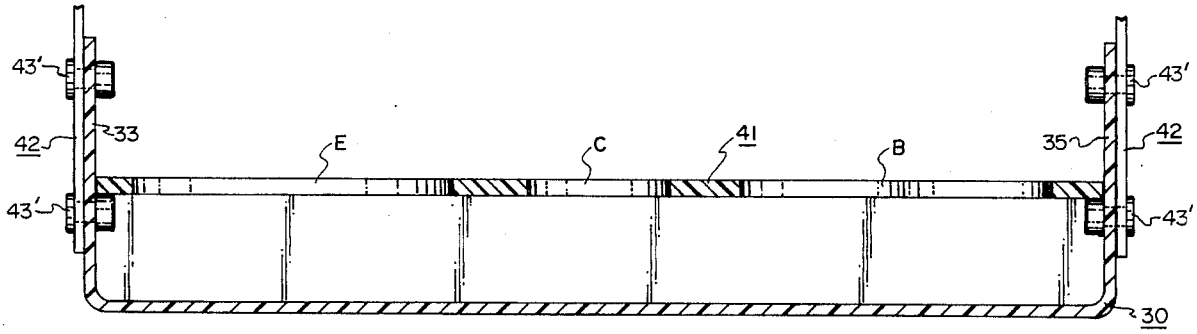
FIG. 5 is an enlarged vertical section, taken along the line 5—5 in FIG. 1, of the tray with its apertured plate shown as installed.

The structure shown in FIGS. 1–4 operate as follows:

The walker is adjustable as to height, by virtue of the structure shown in FIG. 2. Importantly, the protective sponge-like footpads 28 protect the patient's toes against unwanted jarring and injury. The composite patient tray 29 can be easily connected and disconnected to the walker by means of the quick-connect elongate links or engagement members at 46; the latter will generally be permanently secured by plastic ties 48 to crossbar 15 of the walker structure. Accordingly, the entire tray may be removed or installed very quickly, as may be desired.

Importantly, the tray itself has a number of unique, important features. One is that the tray is comprised of two principal members, the tray member and the removable apertured plate. When the plate is installed then the same is useful for supporting dinnerware and other items against inadvertent movement. When the plate is removed, the inner well of tray member 30 is useful for carrying personal items such as books, papers, and other patient items.

Importantly, the mutually opposite upstanding arms 42, affixed to opposite sides 33 and 35 of tray member 30, have rigid connection with such tray member so that there is no pivoting action between the lower portions of the arms 42 themselves and the opposite sides of such tray member. The upper extremities of these upstanding arms have respective apertures essentially planar for suitable connection to the quick-connect structures 46, comprising the opposite articulative links. The incorporation of such links reduce large, swinging movements and enables a more direct gravity-assist, this that jarring is not translated into pronounced tipping of the composite tray.

The loose connection of the ties 48, with the articulative links, allows for flexibility so that jarring and other movements of the walker will not be translated into tipping of the tray and spilling of its contents.

Thus, by way of example, when the patient grasps the handles 16 and 17 and moves the walker with its tray forwardly, then with the locks or detents at 49 being in unlocked position, the tray is free to maintain its horizontal position, essentially undistributed therein, even though the walker is moving and overall configuration of the walker is tipped or tilted. Thus, the locks, as at 49, will be disengaged during intentional movements of the walker. When a particular position is reached, and the patient desires to sit down, for example, then he may do so, push the pins 53 inwardly in the manner shown in FIG. 4, and totally stabilize the composite tray construction relative to the now stationary walker. This so there is both ease and comfort in using the tray for a variety of purposes. When the patient desires to move, he merely unlocks the pins 53 from apertures 57 in FIG. 4, so that now the tray is free, essentially, from any effects of movement or tilting of the walker itself.

Figure 7:
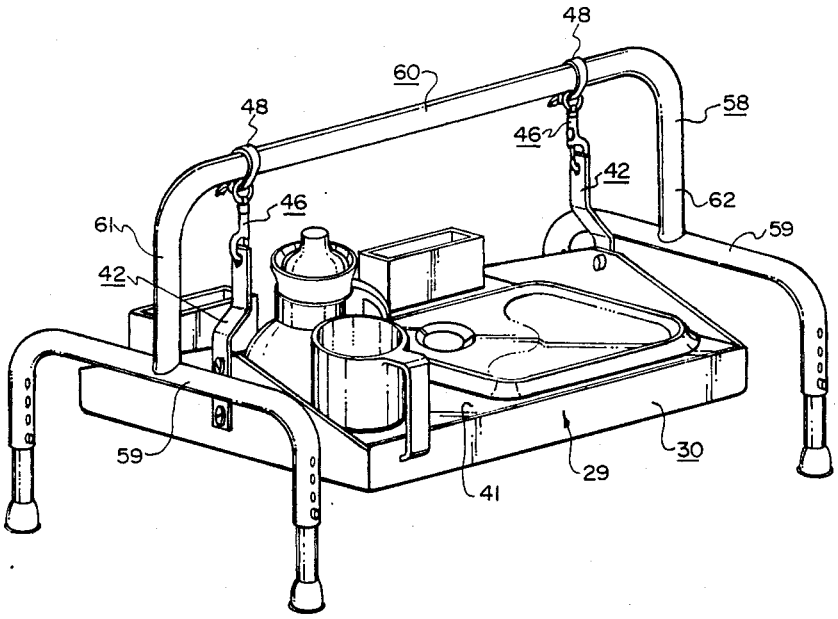
FIG. 7 is a perspective view of the patient tray of the present invention wherein the same is used with supporting structure to comprise bed food tray structure.
Figure 8:
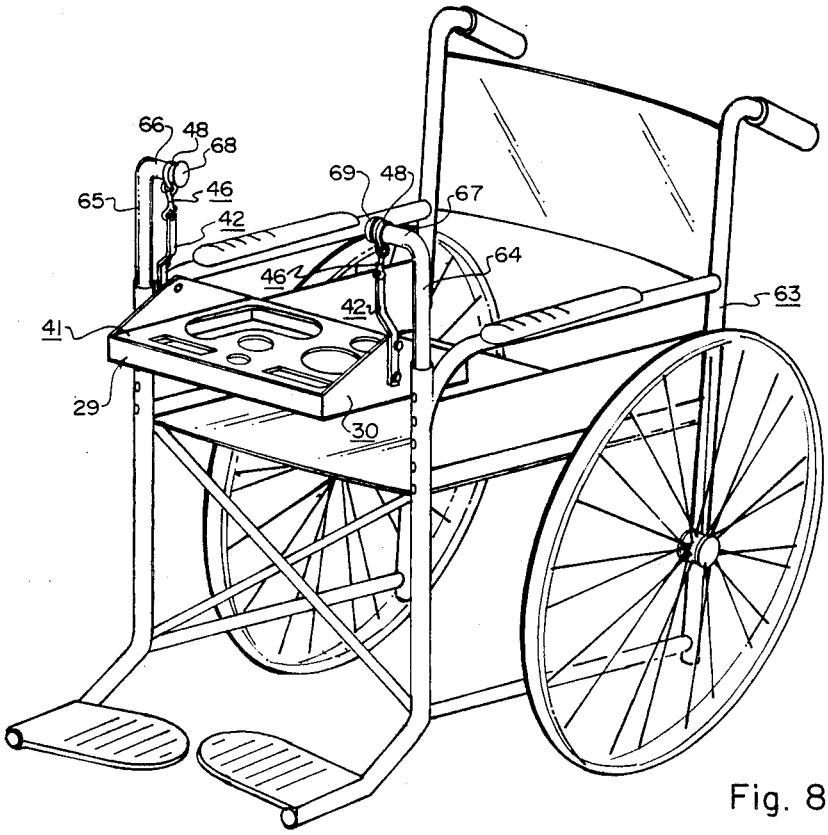
FIG. 8 is a perspective view of a wheelchair incorporating risers for enabling the articulative suspension of the tray therefrom.

FIGS. 7 and 8 illustrate the releasable incorporation of the tray structure, as above described, to bed tray and wheelchair structures, respectively. In FIG. 7, the bed tray frame 58 include inverted U-shaped leg members 59 and a crossbar 60, having depending opposite extremities 61 and 62. Again, the plastic or other ties 48 connect to the quick-connect elongate links 46 as before explained. The composite tray 29 is suspended therefrom by means of connection of the links 46 to the corresponding upstanding arms 42. Since the upper arms are not provided directly to, and proximate the axis of crossbar 60, then any jarring movements and energies associated therewith are quickly dampened so that the tray returns to its desired, horizontal position. In FIG. 8, wheelchair 63 has upstanding adjustable risers 64 and 65, with inwardly turned ends 66 and 67. These ends are provided with caps 68 and 69, as well as with the previously described ties 48. Again, the latter are employed to suspend the links 46 and the upstanding arms 42. Movements, and even sudden jarring, of the wheelchair will not effect the horizontal disposition of the composite tray; furthermore, should the tray itself be jarred, energies resulting therefrom are quickly dampened by virtue of the elongate links and their respective articulative connections to and between support ends 66 and 67 forming, in effect, a composite crossbar structure to support the arms and tray.

Accordingly, in all of the embodiments, ample and unique provision is made in keeping the tray essentially horizontal, notwithstanding intermittent movements of intention or inadvertence relative to the basic structure.

To accommodate left-handed persons, the plate 41 can simply be lifted and then reversed end-for-end to assume an inverted position.

This invention has been described in its presently contemplated best mode, and it is clear that it is susceptible to numerous modifications, modes and embodiments within the ability of those skilled in the art and without the excerise of the inventive faculty. Accordingly, the scope of this invention is defined by the scope of the following claims.

I claim:

1. In combination: a patient support structure having legs; a patient tray including, a tray member having a bottom and contiguous sides standing from the periphery of said bottom; an essentially planar plate provided with receptacle apertures, designed to removably receive receptacles that rest upon said tray bottom, and removably disposed over, engaging, and supported by said sides; mutually opposite upstanding arms fixedly secured to said sides and having upper extensions each provided with a respective aperture; plural, actuatable, linkage means for articulatively securing respective ones of the arms to said support structure; said tray being provided with an aperture in one of said sides for receiving a pin of a hand-actuatable, releasable locking means mounted on one of said legs, to selectively deter relative movement between said tray and said support structure.

2. Structure according to claim 1 wherein each of said means comprises an elongate, manually actuatable link having a lower portion inserted in said aperture of a respective on of said arms and also an upper portion provided with a flexible tie for securement over said structure support.

3. The structure according to claim 1 wherein selected ones of said sides have recessed, upwardly facing shoulders, said plate having a peripheral edge releasably resting upon said shoulders.

4. The structure of claim 1 were those sides to which said upstanding arms are attached extend upwardly above said plate.

* * * * *